US007967472B2

(12) United States Patent
Arndt et al.

(10) Patent No.: US 7,967,472 B2
(45) Date of Patent: Jun. 28, 2011

(54) LIGHT UNIT

(75) Inventors: Joachim Arndt, Brieselang (DE); Uwe Fidler, Berlin (DE); Markus Herb, Langenau (DE); Matthias Lenz, Falkensee (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 231 days.

(21) Appl. No.: 12/447,926

(22) PCT Filed: Nov. 8, 2006

(86) PCT No.: PCT/EP2006/068250

§ 371 (c)(1),
(2), (4) Date: Apr. 30, 2009

(87) PCT Pub. No.: WO2008/055543

PCT Pub. Date: May 15, 2008

(65) Prior Publication Data

US 2010/0061103 A1 Mar. 11, 2010

(51) Int. Cl.
*F21V 19/00* (2006.01)

(52) U.S. Cl. ..... 362/288; 362/217.16; 362/396

(58) Field of Classification Search ..... 362/263, 362/265, 220, 217.14, 217.16, 217.17, 288, 362/285, 418, 217.01; 313/292, 318.07, 318.09, 318.1

See application file for complete search history.

(56) References Cited

U.S. PATENT DOCUMENTS

| | | | | |
|---|---|---|---|---|
| 2003/0168959 | A1* | 9/2003 | Dakin et al. | 313/318.07 |
| 2004/0119393 | A1* | 6/2004 | McCullough et al. | 313/318.09 |
| 2008/0158890 | A1 | 7/2008 | Arndt et al. | |

FOREIGN PATENT DOCUMENTS

| | | | |
|---|---|---|---|
| CA | 2193286 | A1 | 6/1997 |
| CN | 1159536 | A | 9/1997 |
| DE | 102006006063 | A1 | 8/2007 |
| FR | 1574750 | A | 7/1969 |
| WO | 2004046609 | A1 | 6/2004 |
| WO | 2006081804 | A1 | 8/2006 |
| WO | 2007090771 | A1 | 8/2007 |

OTHER PUBLICATIONS

International Search Report of PCT/EP2006/068250 mailed Jul. 5, 2007.

* cited by examiner

*Primary Examiner* — Thomas M Sember

(57) ABSTRACT

The light unit comprises a light source and a reflector. The light source is surrounded by an exterior pipe. Spring clips with a centering effect for the exterior bulb of the light source are anchored at the open end of the exterior pipe.

5 Claims, 3 Drawing Sheets

LIGHT UNIT

BACKGROUND OF THE INVENTION

1. Field of the Invention

The invention proceeds from a light unit in accordance with the preamble of claim 1. What is involved here is, in particular, reflector lamps or other high pressure discharge lamps such as metal halide lamps, or else sodium high pressure discharge lamps. The discharge vessel is generally accommodated in an outer bulb. However, the invention can also be applied in the case of reflector lamps based on halogen incandescent lamps or the like.

2. Description of the Related Prior Art

WO 2004046609 discloses a metal halide lamp provided with a reflector and having a ceramic discharge vessel. An inner vessel is arranged in this case in an outer tube. Such lamps exhibit a combination of a flat clip and cement. In this case, the clip opening surrounds the pinch of the basic lamp, which is located in the neck region of the reflector. Underneath the clip, the neck region is filled with cement mass and fixes the basic lamp positively in the pinch region. It is not evident whether the position of the light center of the discharge vessel is adjusted relative to the reflector focus. Another possible connection is crimping, that is to say the deformation of the metal pins with the aid of pressure methods DE-Az 10 2006 006 063.6 (as yet unpublished) discloses a similar reflector lamp that uses a clip to fasten a cap on the outer tube.

SUMMARY OF THE INVENTION

It is the object of the present invention to specify a method for producing a reflector lamp that ensures simple optical adjustment of the lamp in the reflector.

This object is achieved by characterizing features of claim 1.

Particularly advantageous refinements are to be found in the dependent claims.

It is important in the case of reflector lamps for the light center of the installed burner or the lamp to be located in the calculated focus of the reflector. Deviations cause parameters such as, for example, emission angle, central beam intensity, uniform illumination etc. to change.

The inventive clip simultaneously takes over two functions: firstly the actual centering function, and secondly the holding function of an anti-glare cap.

Firstly, simple radial centering is possible for a basic lamp, also denoted as inner vessel here, inside an outer tube, here often an anti-burst tube. The centering process can be regarded as a part of the assembly, and need not be carried out as an individual process.

In detail, there is presented a light unit having a concave reflector that is provided with an exit opening, a neck and an axis, the reflector surrounding a light source that extends longitudinally in the axial direction and is fitted with a bulb, the light source being surrounded at a spacing by an outer tube, the outer tube having a first end, adjacent to the neck, and a second end, adjacent to the exit opening, the outer tube being connected to the neck in the vicinity of the first end, the outer tube having, at least in the vicinity of the second end, an inside diameter that is loosely adapted to the diameter of the bulb at the exit-side end thereof, there being anchored on the outer tube at least two suitably shaped spring clips that have two limbs and thereby clasp the end of the bulb. The inner limb of the spring clips is respectively bent inward such that it touches the bulb of the light source, the spring clips being arranged distributed on the circumference of the outer tube so widely spaced apart from one another that they act with a centering effect on the bulb.

The outer tube preferably has latching means into which the outer limb of the spring clip can latch. The latching means is, in particular, a channel or local depressions, that is to say at least two depressions on the outer surface of the outer tube.

The loose adaptation signifies a spacing that is so small that it can be bridged by the spring clip. In practice, this is a distance of approximately 0.5 to 3 mm.

The inner limb of the spring clip is preferably bent inward in a V-shaped fashion. In order to avoid damage to the outer tube, the inner limb preferably has a free end that projects inward.

The light source is mostly a discharge lamp with a metal halide fill.

One exemplary embodiment preferably relates to a metal halide lamp with metal reflector, preferably an aluminum reflector. The lamp comprises a number of components that are connected to one another purely mechanically. The light source is a so called basic lamp that is incorporated into a base ceramic. After axial adjustment of the light center to the virtual reflector focus, the supply leads of the basic lamp are crimped with the base pins or contact pins of the base ceramic. An aluminum reflector is likewise fastened on the base ceramic by means of crimping.

The basic lamp has so far been axially adjusted only via the base pin crimping. Radial adjustment of the burner centre relative to the reflector focus is likewise important, and is performed via special centering/holding clips and their arrangement on the top side of an anti-burst tube that takes over the role of the outer tube here.

A plurality of centering/holding clips preferably made from spring steel, are located, preferably spaced apart uniformly, in a fashion distributed over the circumference of the upper end face of an anti-burst tube. The number of the clips is at least three and preferably at most six. The width b of the clips is preferably between 1 mm and 4 mm, the material thickness s is preferably between 0.1 and 0.3 mm. A circumferential bead is integrally formed in the upper region of the outer tube. The clip is formed at an outwardly pointing site such that a projection, a so called "nose", can latch into the circumferential bead of the external surface of the glass tube. At another, inwardly pointing site, the clip has a second, preferably larger, "nose" or "corrugation". This "nose" or "corrugation" takes over the actual centering function. The outwardly angled-away part of the clip serves to fix an anti-glare cap that is incorporated from above via the clips and the outer tube. The angled-away part of the clip fulfils the function of a "barb". After the incorporation of the anti-glare cap, the anti-glare cap can be taken off only with difficulty.

The lower end face of the anti-burst tube is fitted in a similar or identical way with a second clip variant. This type of clips have already been described in DE-Az 10 2006 063.6 as pure holding clips without a centering function. Except for the centering function, this clip variant has similar properties.

The preassembled system, comprising anti-burst tube, anti-glare cap, centering/holding clip and holding clips is, on the one hand, incorporated via the basic lamp crimped into the base ceramic. On the other hand, the lower region of the anti-burst tube dips with the fitted holding clips into the reflector neck. During incorporation, the outer bulb of the basic lamp touches the zone denoted by "nose" or "corrugation", of the at least two centering/holding clips, and is thereby centered. The zone, denoted by "nose" or "corrugation", of the centering/holding clip must rest on the cylindrical part of the basic lamp outer bulb after the incorporation.

When the anti-burst tube, which is already fitted with the holding clips positioned over the circumference, dips into the reflector neck the anti-burst tube is wedged in the reflector neck via the holding clips. The barb function of the holding clips prevents the anti-burst system from being extracted again.

BRIEF DESCRIPTION OF THE DRAWINGS

The invention is intended to be explained in more detail below with the aid of a number of exemplary embodiments. In the drawing.

DESCRIPTION OF THE EMBODIMENTS OF THE INVENTION

Figure 1:
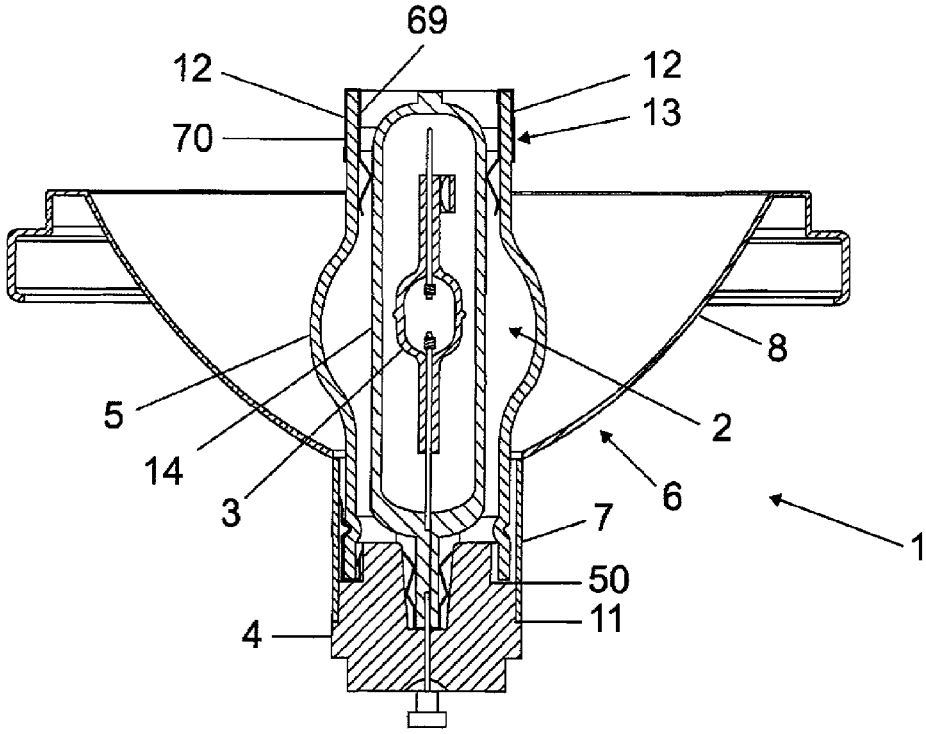
FIG. 1 shows the side view of a reflector lamp.

FIG. 1 shows a reflector lamp 1 with an inner vessel or basic lamp 2 comprising a discharge vessel 3 that is surrounded by an outer bulb 14. The discharge vessel is produced from PCA ceramic and has two capillaries at both its ends. The inner vessel 2 is seated in a central opening in a base 4. The inner vessel 2 is surrounded at a spacing by an anti-burst tube 5 that is basically fashioned cylindrically and is aligned in an axially parallel fashion. The anti-burst tube 5 itself is, in turn, a reflector 6 made from aluminum. The reflector has a neck 7 and a contour 8. The diameter of the neck is advantageously adapted from outside to the diameter of the anti-burst tube 5. Both parts are mounted on the base 4, there being a number of techniques known for this purpose. However, the type of fastening is of no importance here.

The anti-burst tube 5 has an inside diameter that is substantially loosely adapted to the outside diameter of the basic lamp, that is to say here that of the outer bulb 14. What is meant by this is a spacing of approximately 1 to 2 mm that is just so wide that it is bridged by a spring clip 12.

This spring clip is slipped onto the outer tube 5 from the opening of the reflector. Two spring clips 12 are shaped such that they are snapped onto the end of the tube 5 in a fashion similar to a so called tab for files. In this case, the tabs 12 are uniformly distributed over the circumference of the tube. Each tab is in principle bent in a U-shaped fashion with a short outer limb 70 and a long inner limb 69. Adjoining the inner limb is a bent away portion 72 which points inward in a V-shaped fashion and whose deflection from the axis of the inner limb is markedly larger than in the case of the bulge. The ridge 73 of this bent away portion centers the basic lamp. Further adjacent thereto is a slightly protruding free end 74. For detail on this, see FIGS. 5 and 6, dashed version.

The neck of the aluminum reflector is, for example, crimped on the base insulator 4. Lateral bores are provided for this purpose on the base insulator (not illustrated).

In this case, the neck is mounted on a stepped cutout 11 of the base.

At the base end, the anti-burst tube is clamped on the neck of the reflector. The anti-burst tube is seated on the upper edge of a further step 50. Other types of fastening are also possible.

The light source or basic lamp can, for example, be a halogen incandescent lamp or high pressure discharge lamp.

Figure 2:
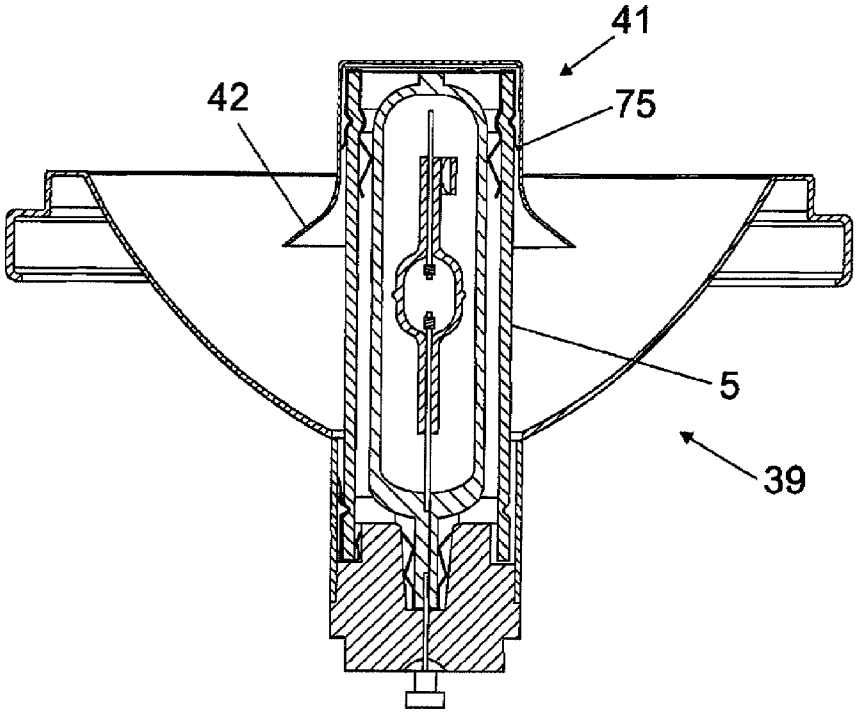
FIG. 2 shows a further exemplary embodiment of a reflector lamp.

Shown in FIG. 2 is a reflector lamp 39 that is fashioned in a way similar to FIG. 1 and, moreover, carries a cover 41 with a shield 42 over the outer tube, which is cylindrical here. The holding of the spring clip is improved here. For this purpose—see FIG. 3 for detail—the outer tube 5 has a circumferential bead 13. The outer limb 70 of the clip is curved such that with a nose 80, see FIGS. 5 and 6, it is held in the channel or in the bead 13. The inner limb 69 is bent such that with a sweeping arc 81 it holds the end of the tube 5 together with the nose 80 on the outer limb 70. The circumferential channel 13 can of course, alternatively be replaced by local depressions, dents etc. In order to hold the cover 41, the open end of the centering spring clip can be bent outward on the external limb, see reference numeral 75 in FIGS. 2 and 5. The inner and outer limbs are connected to one another via a base part 82.

Figure 3:
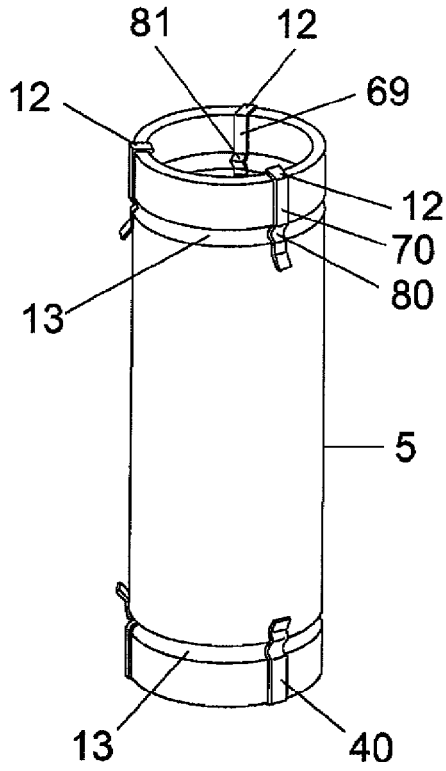
FIG. 3 shows the outer tube from the reflector lamp of FIG. 2.

An anti-burst tube 5 is illustrated in perspective in FIG. 3. It respectively has a circumferential channel 13 at its upper and lower ends. Here, three centering spring clips 12 are uniformly distributed over the circumference at the upper end. Similar spring clips 40, but without a centering device, are mounted on the lower end of the tube 5.

Figure 4:
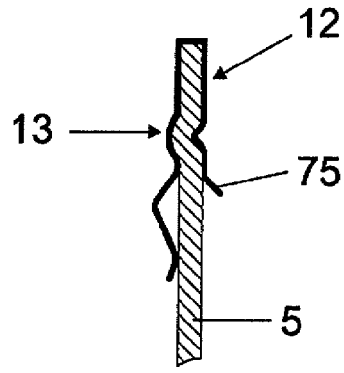
FIG. 4 shows a detail of the outer tube from FIG. 3.
Figure 5:
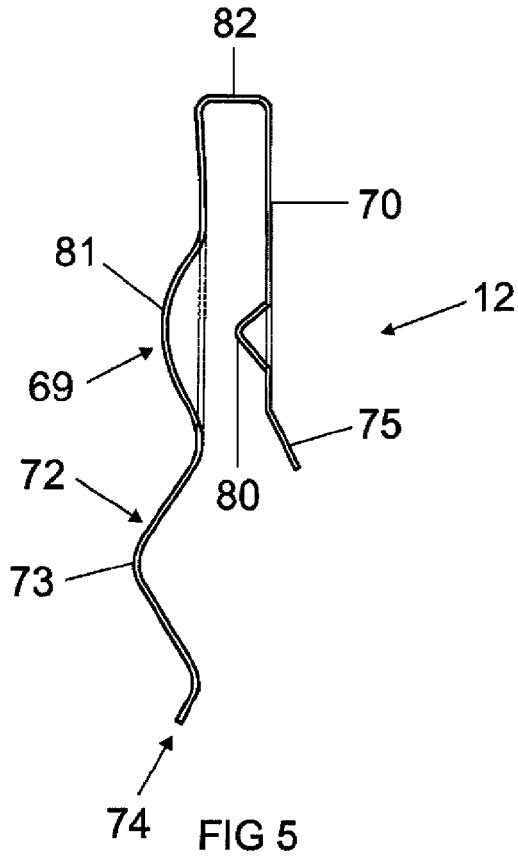
FIG. 5 shows a spring clip in side view.
Figure 6:
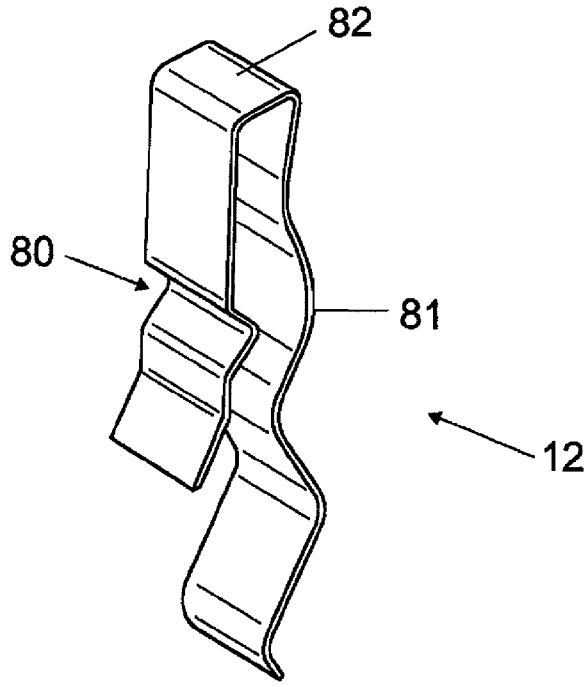
FIG. 6 shows the spring clip from FIG. 5 in perspective view.

FIG. 4 shows this centering clip in detail. FIG. 5 shows a side view, and FIG. 6 a perspective view of the centering spring clip.

Of course, the deflection of the V-shaped bent away portion 72 is larger in the unstressed state than in the functional mode. This difference is not illustrated in the schematic drawings.

The invention claimed is:

1. A light unit having a concave reflector that is provided with an exit opening, a neck and an axis, the reflector surrounding a light source that extends longitudinally in the axial direction and is fitted with a bulb, the light source being surrounded at a spacing by an outer tube, the outer tube having a first end, adjacent to the neck, and a second end, adjacent to the exit opening, the outer tube being connected to the neck in the vicinity of the first end, the outer tube having, at least in the vicinity of the second end, an inside diameter that is loosely adapted to the outer diameter of the bulb at the exit-side end thereof, there being anchored on the outer tube at least two suitably shaped spring clips that have two limbs and thereby clasp the second end of the outer tube, wherein an inner limb of the spring clips is respectively bent inward such that it touches the bulb of the light source, the spring clips being arranged on the circumference of the outer tube so they are widely spaced apart from one another that they act with a centering effect on the bulb.

2. The light unit as claimed in claim 1, wherein the inner limb of at least one spring clip is angled inward in V-shaped fashion.

3. The light unit as claimed in claim 1, wherein the inner limb of at least one spring clip has a free end that is bent inward.

4. The light unit as claimed in claim 1, wherein the light source includes a discharge vessel with a metal halide fill.

5. The light unit as claimed in claim 1, wherein the outer tube has in the vicinity of the second end a channel or, in some sections, depressions into which suitably shaped bulges of the spring clips latch.

* * * * *